US006775937B2

(12) United States Patent
Ruana

(10) Patent No.: US 6,775,937 B2
(45) Date of Patent: Aug. 17, 2004

(54) RAILING ADVERTISING - SURFACE, SYSTEM AND METHOD

(76) Inventor: Bruce M. Ruana, 1781 Bitterbrush Ct., Gardnerville, NV (US) 89410

( * ) Notice: Subject to any disclaimer, the term of this patent is extended or adjusted under 35 U.S.C. 154(b) by 0 days.

(21) Appl. No.: 09/877,409

(22) Filed: Jun. 7, 2001

(65) Prior Publication Data

US 2003/0182830 A1 Oct. 2, 2003

(51) Int. Cl.[7] ..... G09F 7/12; G09F 3/10; G09F 7/18

(52) U.S. Cl. ..... 40/660; 40/638; 40/594

(58) Field of Search ..... 40/638, 574, 660, 40/675, 615; 283/81; 428/40.1, 195; 150/152 R

(56) References Cited

U.S. PATENT DOCUMENTS

| | | | | | |
|---|---|---|---|---|---|
| 3,702,511 | A | | 11/1972 | Miller | 40/306 |
| 4,054,001 | A | | 10/1977 | De Pinna | 40/126 A |
| 4,191,298 | A | | 3/1980 | Broudy | 211/126 |
| 4,568,403 | A | | 2/1986 | Egan | 156/247 |
| 5,007,663 | A | * | 4/1991 | Moran | 283/81 |
| 5,190,267 | A | | 3/1993 | Schmitt et al. | 256/59 |
| RE34,590 | E | | 4/1994 | Schotthoefer | 156/226 |
| 5,330,232 | A | * | 7/1994 | Smith | 283/81 |
| 5,413,384 | A | * | 5/1995 | Principe et al. | 283/81 |
| 5,508,084 | A | * | 4/1996 | Reeves et al. | 428/172 |
| 5,584,096 | A | | 12/1996 | Aurora | 16/111 R |
| 5,665,445 | A | * | 9/1997 | Carney, Jr. | 428/40.1 |
| 5,743,064 | A | | 4/1998 | Bennett | 52/718.04 |
| 5,775,016 | A | | 7/1998 | Chien | 40/544 |
| 5,775,756 | A | | 7/1998 | Rozenich | 294/137 |
| 5,779,228 | A | | 7/1998 | Hansen | 256/65 |
| 5,866,220 | A | * | 2/1999 | Rusincovitch et al. | 428/40.1 |
| 6,025,773 | A | | 2/2000 | Bresnan | 340/407.1 |
| 6,041,533 | A | | 3/2000 | Lemmond, Jr. | 40/584 |
| 6,062,519 | A | | 5/2000 | Baldassarre | 248/311.2 |
| 6,065,852 | A | | 5/2000 | Crumley | 362/146 |
| 6,113,148 | A | * | 9/2000 | Koranda et al. | 283/81 |
| 6,115,985 | A | | 9/2000 | Wu | 52/720.2 |
| 6,174,396 | B1 | * | 1/2001 | Casteel et al. | 156/213 |
| 6,436,496 | B1 | * | 8/2002 | Rackovan et al. | 428/40.1 |
| 2002/0004117 | A1 | * | 1/2002 | Aoki et al. | 428/40.1 |
| 2002/0089173 | A1 | * | 7/2002 | Reidy | 283/74 |
| 2003/0159250 | A1 | * | 8/2003 | Ruana | 16/431 |

OTHER PUBLICATIONS http://www.automotive.dupont.com/en/productServices/teijinFilms/mylar.html□□Dupont website discloses Mylar polyester film, history and use□□Dec. 10, 2003.* http://www.cuttingedgeinc.com/ref/matPAGE4.htm□□Cutting Edge Inc.—Material: Plastic Films discloses Polyester Film description and characteristics□□Dec. 10, 2003.*

Website entitled The Answer: Floorads™, http://www.floor-graphics.com/site/1 solution top f.html printed Apr. 22, 2001, 14 pages total.

Website entitled "Plastatech, Expanded Vinyls", http://222.plastatech.com/pt/home.nsf/public/Expanded Vinyls.htm, 2 pages.

(List continued on next page.)

*Primary Examiner*—D. Glenn Dayoan
*Assistant Examiner*—H. Gutman
(74) *Attorney, Agent, or Firm*—Sierra Patent Group, Ltd.

(57) ABSTRACT

The present invention comprises a wrap-around advertising surface, system and method of advertising on railings or other hand support systems and for use on poles or support beams. The wrap-around advertising surface includes a skin layer permanently adhered to a 4-way stretchable material layer, wherein the 4-way stretchable material layer is releasably adhered to a railing or other hand support system. A backing layer between the skin layer and the 4-way stretchable material layer can be inserted for support. The wrap-around advertising surface of the present invention is designed to be releasably attachable to the railing or other hand support system.

26 Claims, 4 Drawing Sheets

OTHER PUBLICATIONS

B. E. Maki, "Influence Of Handrail Shape, Size And Surface Texture On The Ability Of Young And Elderly Users To Generate Stabilizing Forces And Moments", Prepared for the National Research Council in accordance with: Contract # OSR84–00197: Influence of Handrail Shape, Size and Surface Texture on the Ability of Young and Elderly Users to Generate Stabilizing Forces and Moments, pp. 1–75, Mar. 30, 1985.

* cited by examiner

RAILING ADVERTISING - SURFACE, SYSTEM AND METHOD

BACKGROUND

1. Field

This invention relates to a wrap-around advertising surface, system and method of advertising and more particularly to a wrap-around advertising surface, system and method of advertising on railings or other hand support systems and for use on poles or support beams.

2. Prior Art

Numerous types of media are used to advertise products and services in various settings. The type of advertising media used can vary depending upon the environment in which it is placed.

For example, point of purchase displays are often used to direct consumer attention to product offerings placed inside a store. Large billboards and other types of signage or displays along highways, on windows, on sides of vehicles, and the like are another advertising option and can be effective in attracting the attention of persons passing the display.

Floor graphics are a specific example of a point of purchase display. "Floor graphics" is an advertising industry term used to describe a substrate with graphics printed on the surface thereof, which is placed on the floor near a product display to direct a consumer's attention to a particular product display. Floor graphics are "billboards on the floor" that project an advertising campaign on the floor.

Various types of advertising media can also be effective to attract the attention of large numbers of people, for example, at a concert venue, a stadium, a race track, etc. As an example, billboards are often displayed at the above-mentioned places. Other examples include graphical displays on digital scoreboards, which are used in stadiums to attract the attention of a large number of people attending a particular event and billboards and/or digital graphics in moving vehicles such as buses and trains. While these methods are effective they can also be expensive and time consuming to program, display and change.

Other methods of advertising include advertising on the vertical risers of steps as disclosed in U.S. Pat. No. 6,041,533 to Lemmond, Jr. U.S. Pat. No. 4,054,001 to De Pinna describes a display device for advertising consisting of a vertical support with a unitary sheet of resilient material used for advertising hangings from the vertical support. However, the advertising methods to date are relatively expensive, installment intensive and difficult to display.

Hence there is a need for a wrap-around advertising surface, system and method of advertising which can reach a large number of people while at the same time be cost effective for the advertiser and easy to display. There is also a need for a method of advertising which is easy to apply and can be removed quickly and replaced cost effectively.

SUMMARY

The present invention is a wrap-around advertising surface, system and method of advertising on a railing, other hand support system, pole or beam. The wrap-around advertising surface of the present invention is designed to provide cost effective releasably attachable advertising on any railing, feature, surface, grab-bar, other hand support system, pole or support beam. The wrap-around surface is preferably used on a railing, other hand support system, pole or support beam.

In one aspect of the present invention, a wrap-around advertising surface is provided which is releasably adhered to a surface such as a railing, other hand support device, pole or support beam. The wrap-around advertising surface comprises a skin having an outer surface and an inner surface and a 4-way stretchable material layer having an outer surface and an inner surface. The outer surface of the skin layer is imprinted with printed indicia forming a visual image. The inner surface of the skin layer is permanently adhered from edge to edge to the outer layer of the 4-way stretchable material layer. The inner of the 4-way stretchable material layer is completely covered from edge to edge with a releasable adhesive. In another aspect of the invention, a backing layer with an outer surface and an inner surface is placed between the skin layer and the 4-way stretchable material layer to provide additional support. The outer surface of the backing layer is permanently adhered to the inner surface of the skin layer. The inner surface of the backing layer is permanently adhered to the outer surface of the 4-way stretchable material layer.

In another aspect, a system of advertising is presented. The system comprises a wrap-around advertising surface, which has a skin layer and a 4-way stretchable material layer with an outer surface and an inner surface. The skin layer has an outer surface and an inner surface; the outer surface of the skin layer has printed indicia, which presents a visual image. The inner surface of the skin layer is permanently adhered to the outer surface of the 4-way stretchable material layer. The inner surface of the 4-way stretchable material layer is releasably adhered to a railing. In another aspect of the system of advertising presented, a backing layer with an outer surface and an inner surface is placed between the skin layer and the 4-way stretchable material layer to provide additional support. The outer surface of the backing layer is permanently adhered to the inner surface of the skin layer. The inner surface of the backing layer is permanently adhered to the outer surface of the 4-way stretchable material layer.

In yet another aspect, a method of advertising is presented using the wrap-around advertising surface of the present invention. The method of advertising comprises providing a railing, other hand support system, pole or support beam, etc. having a length and alignment targets in a parallel line along its length. Next, placing the wrap-around advertising surface so that the center lengthwise axis of the wrap-around advertising surface is centered on the axis parallel to the length of the railing, other hand support system, pole, support beam, etc. The wrap-around advertising surface of the present invention has alignment targets disposed along an axis parallel to the lengthwise edge of the wrap-around advertising surface and the wrap-around advertising surface folds around the railing such that the alignment targets of the wrap-around advertising surface align with the alignment targets of the railing and the edges of the wrap-around advertising surface abut when folded around the railing.

The wrap-around advertising surface, system and method of advertising will provide a cost effective advertising vehicle for advertisers who wish to provide point of sale advertising and who wish to reach large groups of consumers.

DETAILED DESCRIPTION

The present wrap-around advertising surface, system and method of advertising will be described more fully hereinafter with reference to the accompanying drawings, in which an illustrative aspect of the invention is shown. This surface, system and method of advertising may, however, be embodied in many different forms and should not be construed as limited to the embodiments set forth herein. Rather this embodiment is provided so that the disclosure will be thorough and complete, and will fully convey the scope of the invention to those skilled in the art. Like numbers refer to like elements throughout.

Figure 1:
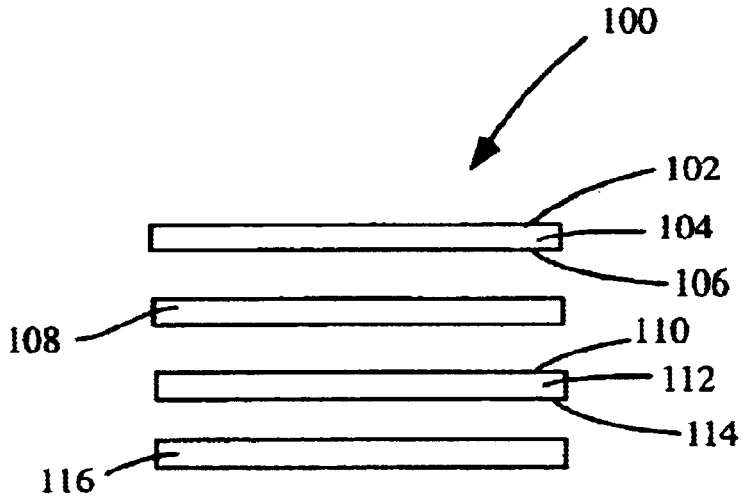
FIG. 1 is an expanded side view of a wrap-around advertising surface.

FIG. 1 discloses wrap-around advertising surface 100 for use on a railing, hand support system, pole or support beam or any other structure which can function as a support surface. Wrap-around advertising surface 100 has a skin layer 104 and a 4-way stretchable layer 112. Skin layer 104 can be formed from a variety of materials. Examples of such materials include expanded vinyl, which is vinyl with a layer of foam that imparts a soft, textured feel, leather, plastic sheeting, plastic roll stock, any type of foam product, polyurethane, urethane, woven fabrics, rubber material, foil material or any other material which could act as a covering to a hand support system. If skin layer 104 is formed from expanded vinyl, the vinyl surface may be smooth or textured. In addition, if a vinyl material is used, the vinyl may be supported or unsupported.

Skin layer 104 has a inner surface 106 which is affixed to the outer surface 110 of 4-way stretchable material layer 112 by a permanent adhesive 108 that completely covers skin layer 104 from edge to edge. The permanent adhesive 108 can be any permanent adhesive known in the art, which will permanently bond skin layer 104 to 4-way stretchable material layer 112. An example of such a permanent adhesive is FLEXCON® adhesive V-402. However, it will be clear to one skilled in the art that other similar suitable adhesives may be used.

Four-way stretchable material layer 112 has outer surface 110 and an inner surface 114, such that outer surface 110 of 4-way stretchable material layer 112 conforms to and is permanently affixed to inner surface 106 of skin layer 104. Four-way stretchable material layer 112 may be comprised of any material that can simultaneously stretch in four directions such as a polyester material; an example is MYLAR®. Inner surface 114 of 4-way stretchable material layer 112 is releasably attached to the railing or hand support system by a layer of releasable adhesive 116. Releasable adhesive 116 completely covers from edge to edge and is affixed to 4-way stretchable material layer 112 and provides releasable adhesion to the railing or hand support system. Releasable adhesive 116 provides secure adhesion to the railing or hand support system but may be removed with a minimal amount of effort by peeling wrap-around advertising surface 100 off the railing or hand support system, etc. Any adhesive having the characteristics of being secured to the railing as well as being easily removed can be utilized. Any acrylic-based adhesive, rubber-based adhesive, or silicone-based adhesive can be utilized; a preferred example of a releasable adhesive is FLEXCON® V-58.

Figure 2:
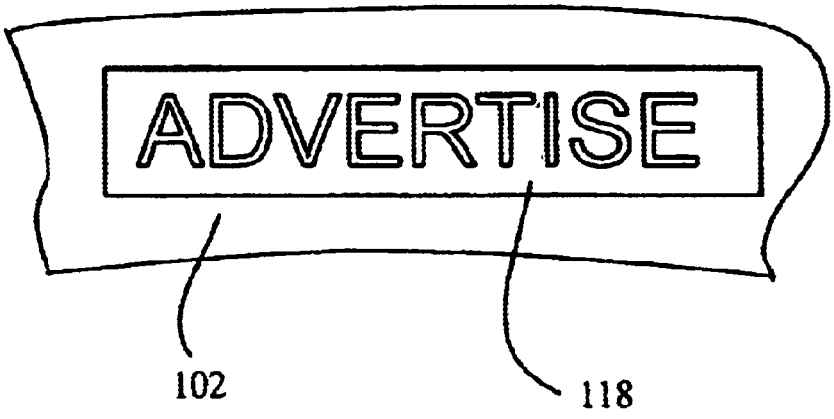
FIG. 2 is an elevated perspective view of the wrap-around advertising surface of FIG. 1.

FIG. 2 is an elevated perspective view of wrap-around advertising surface 100. Skin layer 104 has outer surface 102 and inner surface 106. Outer surface 102 of skin layer 104 has printed indicia that presents visual image 118. Visual image 118 can be created using any printing or graphic technique known in the art suitable for placing graphic designs on the wrap-around material employed. For example, sublimation printing utilizing heat and pressure to affix preprinted graphics produces a highly durable and accurate graphic. The sublimation ink can be pretreated with UV inhibitors to prevent fading. Luminescent inks can also be used to provide a glow in the dark environment. Puff inks can be used to provide a textured surface. In addition, plastisol inks can be used in a heat transfer application for durable, long-lasting images. Wet ink printing can also be used as well as computer generated digital graphics, which are directly printed on various materials used as skin layer 104.

Figure 3:
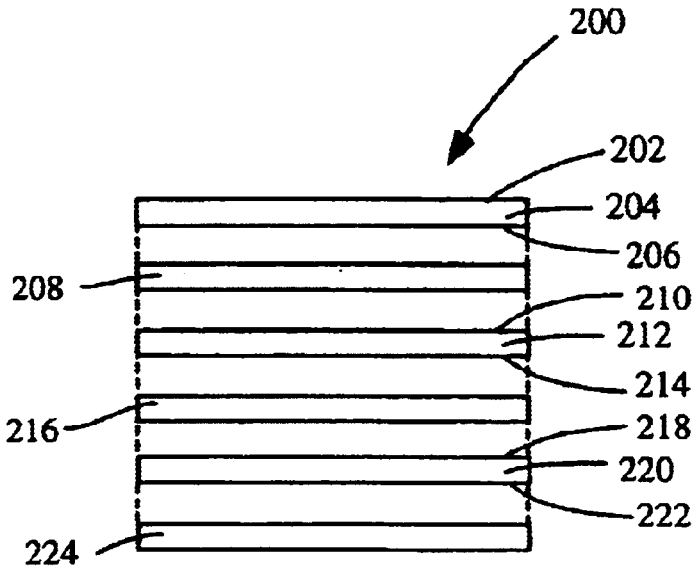
FIG. 3 is an expanded side view of another embodiment of a wrap-around advertising surface.

FIG. 3 discloses wrap-around advertising surface 200 for use on a railing, hand support system, pole or support beam or any other structure which can function as a support surface. Wrap-around advertising surface 200 has a skin layer 204, a backing layer 212 and a 4-way stretchable material layer 220. Skin layer 204 can be formed from a variety of materials. Examples of such materials include, but are not limited to, expanded vinyl, which is vinyl with a layer of foam that imparts a soft, textured feel, leather, plastic sheeting, plastic roll stock, any type of foam product, polyurethane, urethane, woven fabrics, rubber material, foil material or any other material which could act as a covering to a hand support system. If skin layer 204 is formed from expanded vinyl, the vinyl surface may be smooth or textured. In addition, if a vinyl material is used, the vinyl may be supported or unsupported.

Skin layer 204 has an inner surface 206 which is affixed to outer surface 210 of backing layer 212 by a permanent adhesive 208 which completely covers inner surface 214 of backing layer 212 from edge to edge. The permanent adhesive 208 can be any permanent adhesive known in the art, which will permanently bond skin layer 204 to backing layer 212. An example of such a permanent adhesive is FLEXCON® adhesive V-402. However, it will be clear to one skilled in the art that other similar suitable adhesives may be used.

Backing layer 212 has an outer surface 210 and an inner surface 214, such that outer surface 210 of backing layer 212 conforms to and is affixed to inner surface 206 of skin layer 204. Backing layer 212 may be comprised of any material suitable for providing support including open cell foam, closed cell foam, felt, paper or rubber. Inner surface 214 of backing layer 212 is permanently adhered to the outer surface 218 of 4-way stretchable material layer 220. The permanent adhesive 216 attaching inner surface 214 of backing layer 212 to top surface 218 of 4-way stretchable material layer 220 can be any permanent adhesive known in the art which will permanently bond the surfaces, an example of which is FLEXCON® V-402. Four-way stretchable material layer 220 has the ability to stretch in all directions simultaneously such as a polyester material, an example is MYLAR®. Inner surface 222 of 4-way stretchable material layer 220 is releasably attached to the railing or hand support system by releasable adhesive 224. Releasable adhesive 224 is affixed to and completely covers 4-way stretchable material layer 220 from edge to edge and provides releasable adhesion to the railing or hand support system. Releasable adhesive 224 provides secure adhesion to the railing or hand support system but may be removed with a minimal amount of effort by peeling wrap-around advertising surface 200 off the railing or hand support system. Any adhesive having the characteristics of being secured to the railing as well as being easily removed can be utilized. Any acrylic-based adhesive, rubber-based adhesive, or silicone-based adhesive can be utilized; a preferred example of a releasable adhesive is FLEXCON® V-58.

Figure 4:
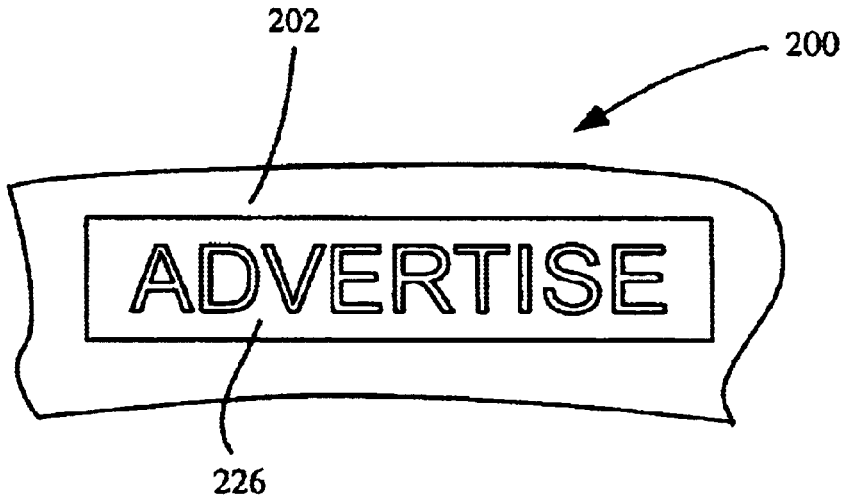
FIG. 4 is an elevated perspective view of the wrap-around advertising surface of FIG. 3.

FIG. 4 is an elevated perspective view of wrap-around advertising surface 200. Skin layer 204 has outer surface 202 and inner surface 206. Outer surface 202 of skin layer 204 has printed indicia that presents visual image 226. Visual image 226 can be created using any printing or graphic technique known in the art suitable for placing graphic designs on the wrap-around material employed. For example, sublimation printing utilizing heat and pressure to affix preprinted graphics produces a highly durable and accurate graphic. The sublimation ink can be pretreated with UV inhibitors to prevent fading. Luminescent inks can also be used to provide a glow in the dark environment. Puff inks can be used to provide a textured surface. In addition, plastisol inks can be used in a heat transfer application for durable, long-lasting images. Wet ink printing can also be used as well as computer generated digital graphics, which are directly printed on various materials used as skin layer 226.

Figure 5:
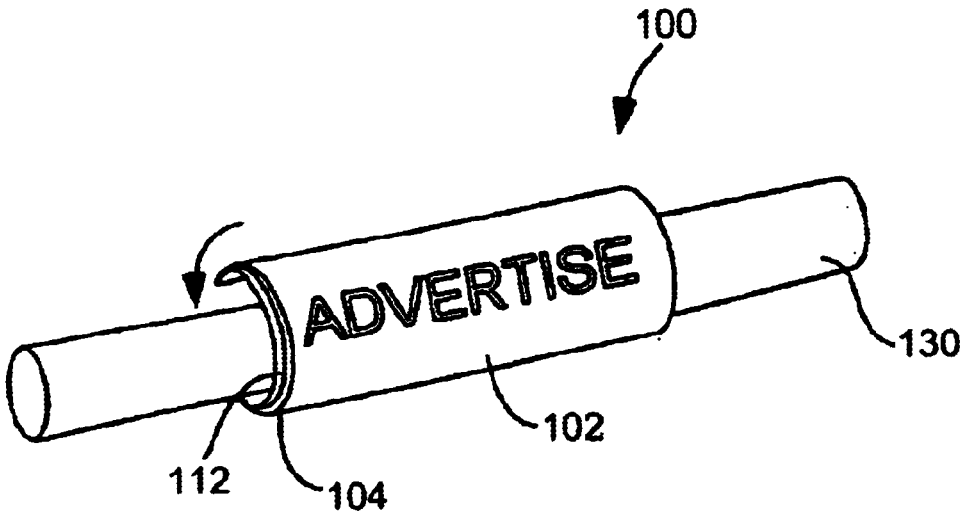
FIG. 5 shows an advertising system for presenting a visual image using the wrap-around advertising surface of FIG. 1.

FIG. 5 discloses an advertising system for presenting a visual image on a railing. For convenience, the component parts of wrap-around surface 100 are numbered as in FIG. 1 designating wrap-around advertising surface 100. The system of the present invention can be utilized with any type of railing or hand support system 120. Wrap-around advertising surface 100 of the present invention has a 4-way stretchable material layer 116 with an inner and outer surface, skin layer 104 which has an inner and an outer surface, the inner surface of the skin layer 104 is permanently adhered to said outer surface of said 4-way stretchable material layer 116. 4-way stretchable material layer 116 is releasably adhered to railing 120. Skin layer 104 and said 4-way stretchable material layer 116 each have a width substantially similar to the circumference of railing 120, such that edges of skin layer 104 and said 4-way stretchable material layer 116 abut when wrapped around railing 120.

Referring now to FIGS. 1 and 5, outer surface 102 of skin layer 104 has printed indicia that presents visual image 118. Visual image 118 can be created using any printing or graphic technique known in the art suitable for placing graphic designs on the wrap-around material employed. For example, sublimation printing utilizing heat and pressure to affix preprinted graphics produces a highly durable and accurate graphic. The sublimation ink can be pretreated with UV inhibitors to prevent fading. Luminescent inks can also be used to provide a glow in the dark environment. Puff inks can be used to provide a textured surface. In addition, plastisol inks can be used in a heat transfer application for durable, long-lasting images. Wet ink printing can also be used as well as computer generated digital graphics, which are directly printed on various materials used as skin layer 104.

Figure 6:
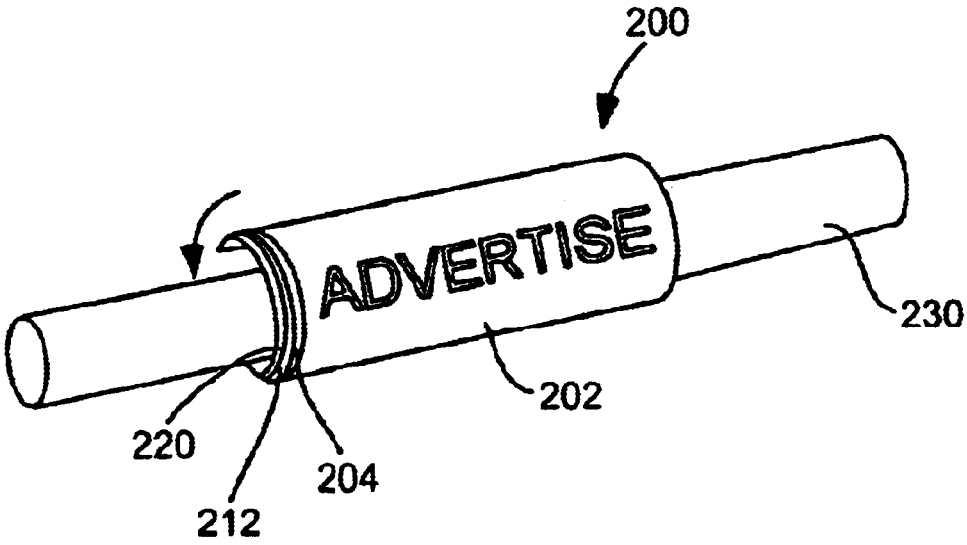
FIG. 6 shows an advertising system for presenting a visual image using the wrap-around advertising surface of FIG. 3.

FIG. 6 discloses yet another advertising system for presenting a visual image on a railing. For convenience, the component parts of wrap-around surface 200 are numbered as in FIG. 3 designating wrap-around advertising surface 200. Wrap-around advertising surface 200 of the present invention has 4-way-stretchable material layer 220 with an inner and outer surface, a backing layer 212 with an inner and outer surface, and a skin layer 204 which has an inner surface and an outer surface. The inner surface of the skin layer 204 is permanently adhered to the outer surface of the backing layer 212. The inner surface of backing layer 212 is permanently adhered to 4-way stretchable material layer 220. Four-way stretchable material layer 220 is releasably adhered to railing 230. Skin layer 204, backing layer 212 and 4-way stretchable material layer 220 each have a width substantially similar to the circumference of railing 230, such that edges of said skin layer 204, backing layer 212 and said 4-way stretchable material layer 220 abut when wrapped around railing 230.

Referring now to FIGS. 3 and 6, outer surface 202 of skin layer 204 has printed indicia that presents visual image 226. Visual image 226 can be created using any printing or graphic technique known in the art suitable for placing graphic designs on the wrap-around material employed. For example, sublimation printing utilizing heat and pressure to affix preprinted graphics produces a highly durable and accurate graphic. The sublimation ink can be pretreated with UV inhibitors to prevent fading. Luminescent inks can also be used to provide a glow in the dark environment. Puff inks can be used to provide a textured surface. In addition, plastisol inks can be used in a heat transfer application for durable, long-lasting images. Wet ink printing can also be used as well as computer generated digital graphics, which are directly printed on various materials used as skin layer 204.

Figure 7:
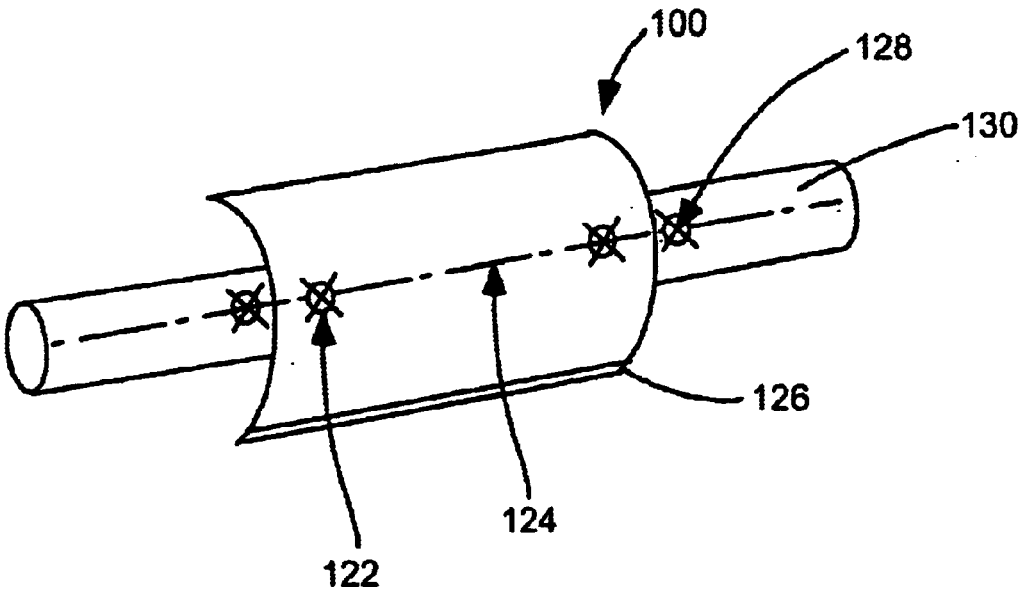
FIG. 7 shows a method of advertising using the wrap-around surface of FIG. 1.

FIG. 7 discloses a method of advertising using wrap-around around advertising surface 100. Wrap-around around advertising surface 100 has alignment targets 122 along axis 124 parallel to lengthwise edge 126 of wrap-around around advertising surface 100. Next alignment targets 128 are placed on railing 120. Next, wrap around surface 100 is placed on railing 120 so that the center lengthwise axis of wrap-around surface 100 is centered on the axis parallel to the length of railing 120. Next, wrap-around advertising surface 100 alignment targets 122 are aligned with railing 120 alignment targets 128. Finally, wrap-around advertising surface 100 has a width substantially similar to the circumference of railing 120 such that when wrap-around advertising surface 100 is folded around railing 120 edges 126 of wrap-around advertising surface 100 abut.

Figure 8:
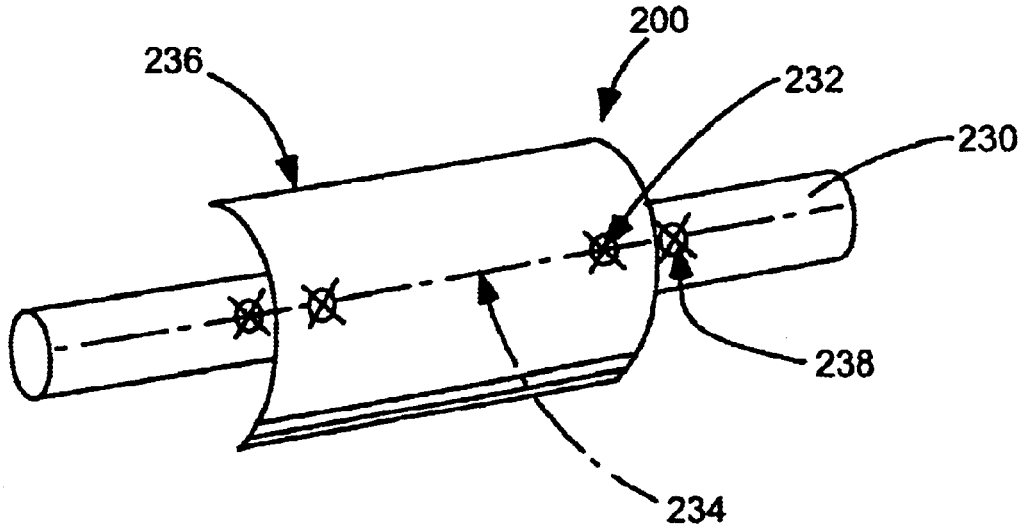
FIG. 8 shows method of advertising using the wrap-around surface of FIG. 3.

FIG. 8 discloses a method of advertising using wrap-around around advertising surface 200. Wrap-around around advertising surface 200 has alignment targets 232 along axis 234 parallel to lengthwise edge 236 of wrap-around around advertising surface 200. Next, alignment targets 238 are placed on railing 230. Next, wrap around surface 200 is placed on railing 230 so that the center lengthwise axis of wrap-around surface 200 is centered on the axis parallel to the length of railing 230. Next, wrap-around advertising surface 200 alignment targets 232 are aligned with railing 230 alignment targets 238. Finally, wrap-around advertising surface 200 has a width substantially similar to the circumference of railing 230 such that when wrap-around advertising surface 200 is folded around railing 230 edges 236 of wrap-around advertising surface 200 abut.

I claim:

1. A wrap-around advertising surface having a width and a length for affixing to a railing, said wrap-around advertising surface comprising:

a skin layer having an outer surface and an inner surface, said outer surface having printed indicia forming a visual image;

a backing layer having an outer surface and an inner surface, said outer surface of said backing layer permanently adhered to said inner surface of said skin layer;

a four-way stretchable material layer with a stretchable outer surface and a stretchable inner surface, said outer surface of said stretchable layer adhered permanently to said inner surface of said backing layer, said inner surface of said four-way stretchable material layer having a layer of releasable adhesive applied thereto;

alignment targets disposed along an axis parallel to a length of the railing; and wherein said wrap-around advertising surface has a width substantially equal to the circumference of the railing.

2. A wrap-around surface as in claim 1, wherein said skin layer has a thickness of about 0.5 millimeter to about 6.25 millimeters.

3. A wrap-around surface as in claim 1, wherein said skin layer comprises expanded vinyl.

4. A wrap-around surface as in claim 3 wherein said expanded vinyl has a textured surface.

5. A wrap-around surface as in claim 3 wherein said expanded vinyl has a smooth surface.

6. A wrap-around surface as in claim 1, wherein said skin layer is selected from the group consisting of leather, plastic sheeting, plastic roll stock, foam material, polyurethane, woven fabric, urethane, rubber and foil.

7. A wrap-around surface as in claim 1, wherein said backing layer is a material selected from the group comprising open cell foam, closed cell foam, elastomer rubber material, felt and paper.

8. A wrap-around surface of claim 1 wherein said alignment targets are approximate to lengthwise ends of said wrap-around surface.

9. A wrap-around surface as in claim 1, wherein said printed indicia is applied to said skin layer by sublimation printing.

10. A wrap-around surface as in claim 1, wherein said printed indicia is applied to said skin layer by heat pressure transfer process.

11. A wrap-around surface as in claim 1, wherein said printed indicia is applied to said skin layer by wet ink printing.

12. A wrap-around surface as in claim 1, wherein said printed indicia is applied to said skin layer by digital graphics.

13. A wrap-around surface as in claim 1, wherein said stretchable layer comprises polyester film.

14. An advertising system having a length and a width for presenting a visual image on a railing, said system comprising;

a four-way stretchable material layer having an outer surface and an inner surface, said inner surface of said four-way stretchable layer releasably adhered to the railing;

a backing layer having an outer surface and an inner surface, said inner surface of said backing layer permanently attached to said outer surface of said stretchable layer;

a skin layer having an outer surface and an inner surface, said inner surface of said skin layer permanently attached to said outer surface of said backing layer, and said skin layer having printed indicia on said outer surface of said skin layer forming the visual image, said skin layer, said backing layer and said four-way stretchable material layer each having a width substantially similar to the circumference of said railing, such that edges of said skin layer, said backing layer and said four-way stretchable material layer abut when wrapped around said railing; and alignment targets disposed along an axis parallel to length of the railing.

15. A system as in claim 14, wherein said skin layer has a thickness of about 0.5 millimeter to about 6.25 millimeters.

16. A system as in claim 14, wherein said skin layer comprises expanded vinyl.

17. A system as in claim 16 wherein said expanded vinyl has a textured surface.

18. A system as in claim 16 wherein said expanded vinyl has a smooth surface.

19. A system as in claim 14, wherein said skin layer is selected from the group consisting of leather, plastic sheeting, plastic roll stock, foam material, polyurethane, woven fabric, urethane, rubber and foil.

20. A system as in claim 14, wherein said backing layer is a material selected from the group comprising open cell foam, closed cell foam, elastomer rubber material, felt and paper.

21. A system of claim 14 wherein said alignment targets are approximate to lengthwise ends of said system.

22. A system as in claim 14, wherein said printed indicia is applied to said skin layer by sublimation printing.

23. A system as in claim 14, wherein said printed indicia is applied to said skin layer by heat pressure transfer process.

24. A system as in claim 14, wherein said printed indicia is applied to said skin layer by wet ink printing.

25. A system as in claim 14, wherein said printed indicia is applied to said skin layer by digital graphics.

26. A system as in claim 14, wherein said four-way stretchable layer comprises polyester film.

* * * * *